US005160485A

United States Patent [19]

Jaillet et al.

[11] Patent Number: 5,160,485

[45] Date of Patent: Nov. 3, 1992

[54] THERMOPLASTIC FABRIC

[75] Inventors: Bernard Jaillet, Mery; Jean-Marc Berthier, Lambesc, both of France

[73] Assignee: Hexcel-Genin, Villeurbanne, France

[21] Appl. No.: 506,194

[22] Filed: Apr. 9, 1990

[30] Foreign Application Priority Data

Apr. 14, 1989 [FR] France ..... 89 05237

[51] Int. Cl.[5] ..... B32B 3/12

[52] U.S. Cl. ..... 428/116; 428/246; 428/251; 428/252; 428/253; 428/257; 428/408; 428/902

[58] Field of Search ..... 428/116, 257, 258, 259, 428/408, 123, 246, 252, 253, 251

[56] References Cited

U.S. PATENT DOCUMENTS

| | | | |
|---|---|---|---|
| 4,389,447 | 6/1983 | Disselbeck et al. | 428/178 |
| 4,759,976 | 7/1988 | Dutt | 428/259 |
| 4,800,113 | 1/1989 | O'Connor | 428/296 |
| 4,840,828 | 6/1989 | Bötger et al. | 428/116 |
| 4,931,345 | 6/1990 | Böttger et al. | 428/116 |

FOREIGN PATENT DOCUMENTS

| | | |
|---|---|---|
| 0056592 | 7/1982 | European Pat. Off. . |
| 0193478 | 9/1986 | European Pat. Off. . |
| 0299309 | 1/1989 | European Pat. Off. . |
| 3124771 | 1/1983 | Fed. Rep. of Germany . |

*Primary Examiner*—James J. Bell
*Attorney, Agent, or Firm*—Oliff & Berridge

[57] ABSTRACT

A fabric made up of thermoplastic fibers and of reinforcing fibers, comprising, in a superposed manner, at least two tissues (1, 4) joined firmly to each other, in which in order to obtain a thermoplastic fabric, at least one (1) of the superposed tissues is dedicated to reinforcement and comprises predominantly fibers (2, 3) of reinforcing material, and at least one other (4) of the superposed tissues constitutes a thermoplastic matrix and comprises predominantly fibers (5, 6) of thermoplastic resin, while the gap (8) between a reinforcing tissue (1) and an adjacent thermoplastic tissue (4) is free of any inserted material other than that (7) used to join these two tissues firmly together.

9 Claims, 2 Drawing Sheets

THERMOPLASTIC FABRIC

BACKGROUND OF THE INVENTION

The present invention relates to thermoplastic fabrics which can be shaped and wrought directly by the action of heat, to obtain various rigid objects or articles which have a relatively large developed surface, for example hollow objects.

DESCRIPTION OF THE PRIOR ART

According to the state of the art, a fabric of this kind generally comprises thermoplastic fibers and reinforcing fibers, integrated within and distributed uniformly over the surface of the fabric. The latter is generally obtained according to traditional weaving processes even if, of course, a technical weaving is involved.

After a fabric of this kind has been appropriately cut up, it may be wrought directly in various ways, especially:

after softening of the thermoplastic fibers, by stamping rather like sheet metal by press molding, in an open or closed mold, with the action of heat by molding in an autoclave.

Furthermore, in accordance with document EP-A-0,229,309, a fabric has been described comprising at least two superposed tissues, each made of rigid fibers acting as a reinforcement, and fibers connecting the rigid fibers, of thermoplastic nature, all these fibers being woven into at least two superposed tissues. The latter are connected together by binding fibers, which are independent of the assembled tissues or taken from either or both of the said tissues. Relatively rigid packing fibers, independent of the two tissues, are inserted as weft between the latter and provide a filling of the gap between the two tissues.

These fabrics are wrought and shaped in a number of stages, firstly by cutting and shaping which is limited by the rigidity of the packing fibers, and then by impregnation with a heat-curable plastic added on both sides of the cut-out fabric while it is held in shape.

Although it is made up partially of thermoplastic fibers, owing to the nature of the plastic which is chosen, a fabric of this kind is not a thermoplastic fabric such as defined above, meaning that it cannot be wrought and shaped directly by heat. Furthermore, the weight proportion of the fibers of thermoplastic material is quite insufficient to make the latter behave, on melting, as a matrix, that is to say a bulk binder of the rigid fibers.

Finally, the fabric according to document EP-A-0,229,309 can be used only as a surface support, and not in depth, for coating with a heat-curable resin, with or without molding.

In accordance with document EP-A-0,056,692, a rigid composite was proposed, whose central core or nucleus consists of a fabric comprising two superposed tissues, joined together by rigid fibers, endowing the combination with a resistance to crushing. The two tissues are coated on their respective outer faces with a heat-curable resin, optionally filled or reinforced with a mat of fibers, for example of glass fibers.

As already described in document EP-A-0,229,309, a fabric consisting of a double tissue is encountered again, used for coating with a heat-curable resin and in no case is there a question of a thermoplastic fabric, as defined above, that is to say a fabric which can be shaped directly with the action of heat to result in all kinds of rigid, generally hollow, objects or structures.

SUMMARY OF THE INVENTION

The subject of the present invention is a reinforced thermoplastic fabric which has an improved shapability in terms of flexibility and deformability, enabling relatively complex shapes to be draped or matched.

Another subject of the present invention is a thermoplastic fabric which makes it possible to localize and vary in a precise, practically limitless, manner the quantity of thermoplastic resin which is applied per unit of surface area.

Another subject of the present invention is a thermoplastic fabric, the technology of obtaining which remains traditional or conventional, and stems essentially from the production processes of the textile industry.

According to the present invention, the starting point is a traditional textile structure composed of at least two, or even many more, superposed tissues, these tissues being joined firmly to each other or some to others, by conventional means, such as binding fibers, stitching, and the like. However, in a way which is determining according to the invention, the thermoplastic and reinforcing fibers are distributed in the fabric in the following manner:

at least one of the superposed tissues is dedicated to reinforcement and, for this purpose, comprises predominantly reinforcing fibers and at least one other of the superposed tissues is dedicated to obtaining the thermoplastic matrix and comprises for this purpose predominantly thermoplastic resin fibers.

Also, the gap between a reinforcing tissue and an adjacent and superposed thermoplastic tissue belonging to the same fabric is free of any inserted material such as a packing material or packing fibers, other than that used to join the two adjacent tissues firmly together.

The fact that a tissue is dedicated to reinforcement does not rule out the possibility of its comprising, in a hybrid manner but in a minor proportion, thermoplastic resin fibers.

The fact that a tissue is dedicated to obtaining the thermoplastic matrix does not rule out the possibility of its comprising, in a hybrid manner but in a minor proportion, reinforcing fibers.

The firm binding of the tissues to each other can be obtained by any appropriate means of binding or linking, for example according to weaving or knitting methods. In particular, the connecting fiber can be separate from the tissues, can be added in some manner, or can belong to either or both of the tissues. The linking may be obtained by sewing the tissues together.

The following definitions must be given for the interpretation and the understanding of the present invention. "Fiber" means both a continuous filament and an assembly of great length of noncontinuous filaments held together by any appropriate means, such as twisting.

"Predominantly comprising" means the fact that the unit of surface area of the tissue in question contains a predominant weight percentage of the fibers of the material in question.

"Tissue" refers to an interlacing of warp fibers and of weft fibers, whatever the relative orientations of these fibers.

By way of thermoplastic resin which can be employed according to the invention there may be mentioned, by way of example, the following substances:

polyetherimides (PEI for short)
polyetheretherketones (PEEK for short)
polycarbonate
liquid crystal polymers (LCP for short)
polyphenylene sulfides (PPS for short)
polyethersulfides (PES for short).

"Reinforcement" means, in the case of the material, fiber or tissue in question, the property according to which the latter has a mechanical strength greater than that of the adjacent material, fiber or thermoplastic tissue.

This may involve a conventional, nonthermoplastic reinforcing material such as:

glass
aramid
carbon
silica.

It may also involve a thermoplastic material different from the adjacent one in its mechanical or heat resistance properties.

"Thermoplastic matrix" means a mass of a plastic material embedding or integrating the reinforcing fibers after heating and endowing the whole with coherence, cohesion and rigidity.

The present invention provides the following determining advantages.

The dedication of the reinforcement and thermoplastic matrix functions to at least two tissues respectively makes it possible, if desired, to distribute and apportion the thermoplastic resin in a uniform and homogeneous manner over the entire surface area and within the thickness of the fabric when it is shaped using heat. To do this, it suffices to apply the desired pressure to both faces of the fabric when it is shaped using heat, with or without molding.

However, conversely, the invention also makes it possible to localize and add the thermoplastic resin in a differentiated and controlled manner, this being done by an appropriate weaving of the thermoplastic tissue relative to the reinforcing tissue. Thus, if it is desired to increase the quantity of thermoplastic resin in a given region of the surface area of the final object, it suffices to provide a greater density or surplus of thermoplastic fibers in the corresponding region of the thermoplastic tissue (before shaping). This can make it possible, for example, to obtain local ribs on some articles such as luggage boxes for aircraft cabins.

In the same way, the invention also makes it possible to localize and contribute a differentiated and controlled reinforcement by an appropriate weaving of the reinforcing tissue in relation to the thermoplastic tissue.

Finally, by determining the weave of the reinforcing tissue, in correspondence with the weave of the matrix tissue, it is possible to obtain and completely control the surface appearance of the shaped articles or objects.

The thermoplastic or matrix tissue and the reinforcement tissue can be obtained together in a single stage of manufacture, continuously, according to the usual weaving methods. In particular, reference will usefully be made to the following works whose content is integrated insofar as is needed into the present description:

"Le tissage et ses armures" (Weaving and weaves) by H. Duquesne, published by the Institut Textile de France in 1976, pages 74 to 78;

"Anciens tissus de la fabrique, de la soierie et du tissage lyonnais, Manuel de théorie du tissage" (Old cloths of the manufacturing, silk and weaving industries of Lyon, Manual of weaving theory), Volume I plain—cloths, by Claude Villard, pages 187 to 202;

"Cours de théorie de tissage, la soie, tissus unis, armures classiques" (Textbook of weaving theory: silk, plain cloths, traditional weaves) by Felix Guicherd, pages 248 to 255.

The linkings between superposed tissues can be produced by binding points obtained by:

warps of the matrix tissue and/or of the reinforcing tissue,
wefts of the matrix tissue and/or of the reinforcing tissue,
additional warps, distinct from the matrix tissue and from the reinforcing tissue,
additional wefts, distinct from the matrix tissue and from the reinforcing tissue,
and any appropriate combinations of the above linking points.

DESCRIPTION OF THE PREFERRED EMBODIMENTS

Figure 1:
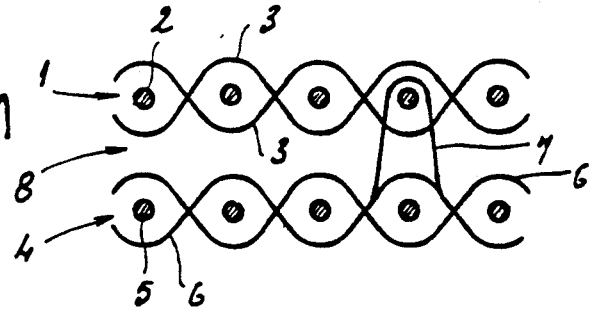

FIG. 1 of the appended drawing illustrates diagrammatically the structure of a tissue in accordance with the invention. A tissue of this kind comprises:

a reinforcing tissue 1 made up of warp fibers 2 and of weft fibers 3
a thermoplastic, matrix tissue 4, made up of warp fibers 5 and of weft fibers 6.

The linking of the two tissues is obtained by binding with some warp fibers 7 belonging to the thermoplastic matrix tissue 4.

A table below illustrates the invention by setting out four examples.

| | EXAMPLE 1 | | EXAMPLE 2 | EXAMPLE 3 | EXAMPLE 4 |
|---|---|---|---|---|---|
| Reinforcing material fiber | | | | | |
| nature | glass | carbon | carbon | glass | carbon |
| count | 68 tex | 200 tex | 200 tex | 68 tex | 200 tex |
| Thermoplastic resin fiber | | | | | |
| nature | polyetherimide (PEI for short) | | polyetheretherketone (PEEK for short) | polyetherimide | liquid crystal polymers (LCP for short) |
| count | 48 tex | | 100 tex | 48 tex | 100 tex |
| Reinforcing tissue | glass | carbon | | | |
| Number of warp fibers | 8.3 | 1.4 | 7 | 22.2 | |
| Number of weft fibers | 8.3 | 1.4 | 7 | 20.7 | |
| weave | taffeta | | 5 satin | 8 satin | |
| weave ratio | 2 | | 5 | 8 | |
| weight/unit of surface | 175 g/m$^2$ | | 285 g/m$^2$ | 300 g/m$^2$ | |

-continued

| | EXAMPLE 1 | EXAMPLE 2 | EXAMPLE 3 | EXAMPLE 4 |
|---|---|---|---|---|
| area | | | | |
| Thermoplastic tissue | | | | |
| Number of warp fibers | 9.7 | 7 | 11.1 | |
| Number of weft fibers | 9.7 | 7 | 20.7 | |
| weave | taffeta | taffeta | coarse row | |
| weave ratio | 2 | 2 | 2 fibers 4 strokes | |
| weight/unit of surface area | 95 g/m$^2$ | 145 g/m$^2$ | 155 g/m$^2$ | |
| Binding | warp fiber of the thermo-plastic tissue | warp fiber of the thermoplastic tissue | warp fiber of the thermo-plastic tissue | warp fiber of the thermoplastic tissue |

Figure 2:
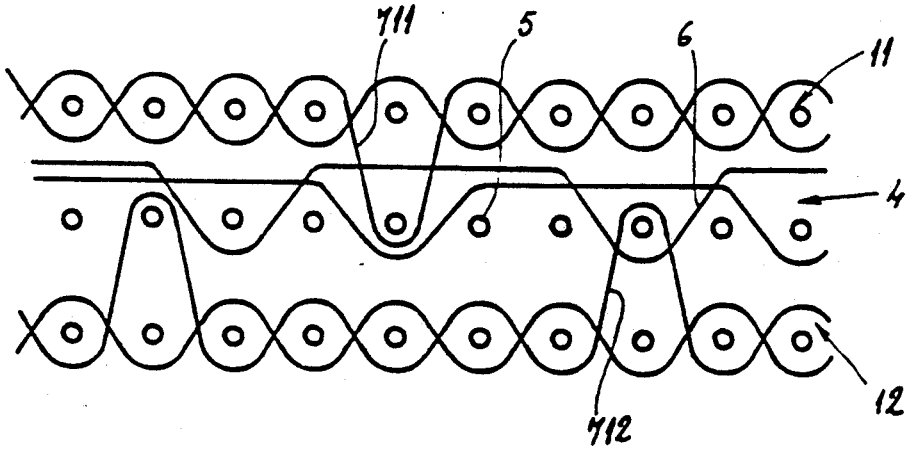

In accordance with FIG. 2, the fabric comprises two thermoplastic outer tissues 11 and 12 and an inserted internal reinforcement tissue 4. The binding fibers 711, 712 belong to the two thermoplastic tissues 11 and 12 respectively, so as not to disturb the straightness of the reinforcing fibers 5 and 6.

By way of example, a triple tissue fabric in accordance with FIG. 2 comprises:

a thermoplastic tissue 11 of cloth weave a reinforcing tissue 4 of carbon fibers, weighing 280 g/m$^2$, of 5 satin a thermoplastic tissue 12 of cloth weave.

A fabric in accordance with FIG. 2 has the effect of endowing the articles obtained with a smooth and definitive surface appearance.

By way of an alternative form of the embodiment according to FIG. 2:

the first thermoplastic tissue 11, for example of PEEK or polycarbonate, can be used to consolidate the reinforcing tissue 4, to obtain a structural laminate, the second thermoplastic tissue 12, for example of PPS or PES, can be used to bond adhesively a cellular material with tubular cells, for example a honeycomb.

The second thermoplastic tissue 12 can be added solely in places where the adhesive bonding is to take place. This makes it possible to make, in a single operation, an article comprising "monolithic" parts and "sandwich" parts.

Figure 3:
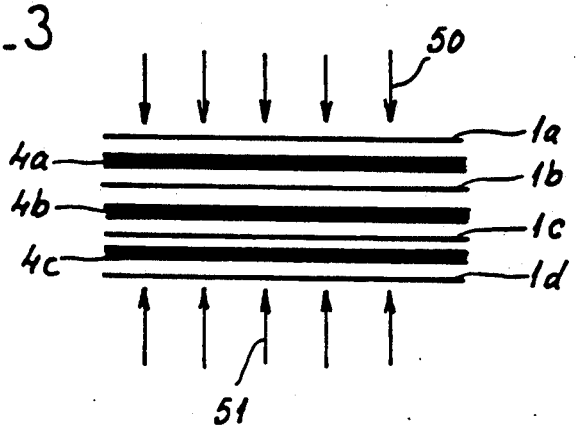

In accordance with FIG. 3, a thermoplastic fabric according to the invention has been shown, consisting of the superposition of a number of thermoplastic tissues 1*a* to 1*d*, and of a number of reinforcing tissues 4*a* to 4*c*, a reinforcing tissue being inserted between two thermoplastic tissues. The shaping of a fabric of this kind is performed by the action of heat, with a pressure applied to both sides of the fabric, in the directions 50 and 51 in opposite directions.

Figure 4:
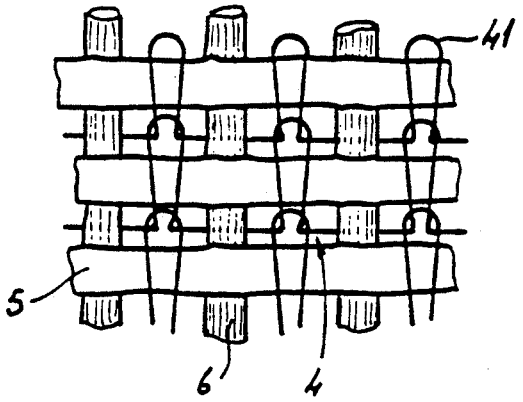

In accordance with FIG. 4, a reinforcing tissue 4 is shown, consisting of reinforcing fibers 5 and 6, joined together by a thermoplastic fiber 41 joining the different fibers 5 and 6 by a warp knitting technique. This reinforcing tissue can be combined with a thermoplastic tissue to obtain a fabric according to the invention.

Figure 5:
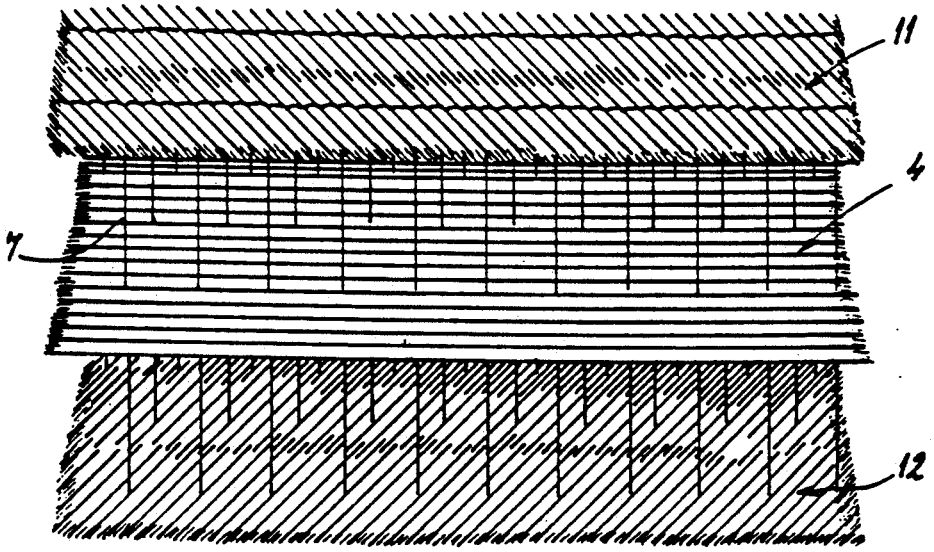

In accordance with FIG. 5, a fabric according to the invention and according to the embodiment of FIG. 2 is shown, in which the different tissues 4, 11 and 1 are joined to each other using the so-called Raschel or Mali technique.

We claim:

1. A thermo-plastic fabric capable of being shaped or wrought into rigid form, directly by the action of heat, comprising:

a first woven fabric formed predominantly of fibers of thermoplastic material for forming a thermoplastic matrix;

a second woven fabric superimposed in contacting relationship with the first woven fabric, and formed predominantly of fibers of reinforcing material for reinforcing said thermoplastic matrix once formed;

joining means for joining the first and second woven fabrics together at spaced locations.

2. A fabric as in claim 1, further comprising reinforcement fibers in the first woven fabric.

3. A fabric as in claim 1, further comprising thermoplastic fibers in the second woven fabric.

4. A fabric as in claim 1, further comprising:

a third woven fabric formed predominantly of thermoplastic fibers superimposed in contacting relationship with the surface of the second woven fabric opposite the first woven fabric; and means for joining the third woven fabric to the second woven fabric at spaced locations.

5. A fabric as in claim 4, wherein the thermoplastic fibers of the first woven fabric, upon melting, serve as a matrix for the reinforcement fibers of the second woven fabric; and the thermoplastic fibers of the third woven fabric, upon melting, serve as an adhesive for adhering the fabric to a surface.

6. A fabric as in claim 1, wherein the joining means comprises a binding fiber knitted into the first and second woven fabrics.

7. A fabric as in claim 1, wherein the joining means comprises a binding fiber woven into the first and second woven fabrics.

8. A fabric as in claim 1, wherein the material forming the reinforcing fibers is selected from the group consisting of glass, aramid, carbon and silica.

9. A fabric as in claim 1, wherein the material forming the thermoplastic fibers is selected from the group consisting of polyetherimides, polyetherketones, liquid crystal polymers, polyphenylene sulfides, polyether sulfides and polycarbonates.

* * * * *